US005590884A

United States Patent [19]

Goldberg

[11] Patent Number: 5,590,884

[45] Date of Patent: Jan. 7, 1997

[54] MANIPULATIVE STICK GAME

[75] Inventor: Ziv Goldberg, Ashdod, Israel

[73] Assignee: Stik-Tak, Ltd., Tel Aviv, Israel

[21] Appl. No.: 582,153

[22] Filed: Jan. 2, 1996

[51] Int. Cl.[6] ..... A63B 67/00

[52] U.S. Cl. ..... 473/514

[58] Field of Search ..... 273/317, 327, 273/412, 413, 414, 428

[56] References Cited

U.S. PATENT DOCUMENTS

| | | | |
|---|---|---|---|
| 2,364,137 | 12/1944 | Gibb | 273/428 |
| 3,106,039 | 10/1963 | Simpson | 273/327 X |
| 3,528,659 | 9/1970 | Benham | 273/327 |
| 4,750,745 | 6/1988 | Benham | 273/327 |
| 4,881,741 | 11/1989 | Shapiro | 273/327 |
| 4,895,377 | 1/1990 | Arbor | 273/327 |
| 5,039,108 | 8/1991 | Arbor | 273/327 |

FOREIGN PATENT DOCUMENTS 1601665 10/1970 France .

*Primary Examiner*—William H. Grieb
*Attorney, Agent, or Firm*—Sol Sheinbein

[57] ABSTRACT

A game comprising a main ;stick connected at each end to an endcap having an inner-facing surface and an opposite outer end. A pair of manipulator sticks are held by a player for manipulating the main stick at the inner-facing surface of one of the endcaps on either side of the main stick so as to toss it into the air and catch it via one of the endcaps. This is accomplished by steadying the main stick on one side with one of the manipulator sticks as it comes towards the player and immediately locating the other manipulator stick on an opposite side of the main stick. Any natural tendency for the main stick to fall causes the inner-facing surface of one of the endcaps to come to rest on the two manipulator sticks.

12 Claims, 3 Drawing Sheets

| Component | Weight (gram) | Weight Range (gram) | Size (cm) | Size Range (cm) | Perimeter (mm) | Perimeter Range (mm) | Form |
|---|---|---|---|---|---|---|---|
| Main Stick | 70 | 50-90 | 52 | 32-72 | 14 | 7-21 | Tubular |
| Manipulator sticks | 35 | 10-60 | 47.5 | 25-70 | 10 | 5-15 | Tubular |
| Endcap core | 10 | 5-15 | 7.25 | 5-10 | 5.25 | 2.5-10.0 | Round |
| Endcap envelope | 7.25 | 2.5-12.5 | 15.0 l<br>22.5 w | 5-25 l<br>12.5-32.5 w | adds 0.5 | 1-9 | Planar roll |

FIG. 4

MANIPULATIVE STICK GAME

FIELD OF THE INVENTION

This invention relates to a stick game for developing manipulative skills.

BACKGROUND OF THE INVENTION

For many years children have tested their manipulative skills using a stick game marketed under the name "Devil Stick" which comprises a main stick having a pair of pompons at either end and which is juggled in the air using a pair of hand sticks held by the player. The pompons lend weight to the main stick as well as rendering it more attractive but the main stick is manipulated at its center of gravity, generally equidistant between the two pompons. Whilst the "Devil Stick" can be tossed into the air and caught by the hand sticks, this requires a degree of skill which is only acquired after long practice and is which is not within the capability of young children.

French patent number 1 601 665 (Abrard) discloses a similar game comprising a long object to be kept in the air by two sticks held in the player's hands and which is larger and heavier at the ends than in the middle. The long object is formed of generally light material surfaced with spongy adherent material preferably in the shape of a hyperboloid of revolution. Here also the long object is manipulated at its center of gravity and is beyond the skill of young players without adequate practice.

SUMMARY OF THE INVENTION

It is an object of the invention to provide a stick game of generally similar appearance to the games described above but conceptually different in that the stick is manipulated not at its center of gravity, but rather under the base of one of the pompons. This makes the game much simpler to manipulate and well within the grasp of young children with very little practice.

According to the invention there is provided a game comprising a main stick connected at opposite ends thereof to respective endcaps each having a respective inner-facing surface, and a pair of manipulator sticks for holding in respective hands of a player for manipulating the main stick at the inner-facing surface of one of the endcaps on either side of the main stick.

It has been found by trial and error that the game works best when the dimensions and weights of the various components of the game are maintained within specific ranges, as will now be defined in detail with regard to a preferred embodiment of the invention.

BRIEF DESCRIPTION OF THE DRAWINGS

In order to understand the invention and see it may be carried out in practice, a preferred embodiment will now be described, by way of non-limiting example only with reference to the accompanying drawings, in which:

FIG. 4 shows in tabular form preferred values of dimensions for the components illustrated in FIG. 1.

DETAILED DESCRIPTION OF A PREFERRED EMBODIMENT

Figure 1:
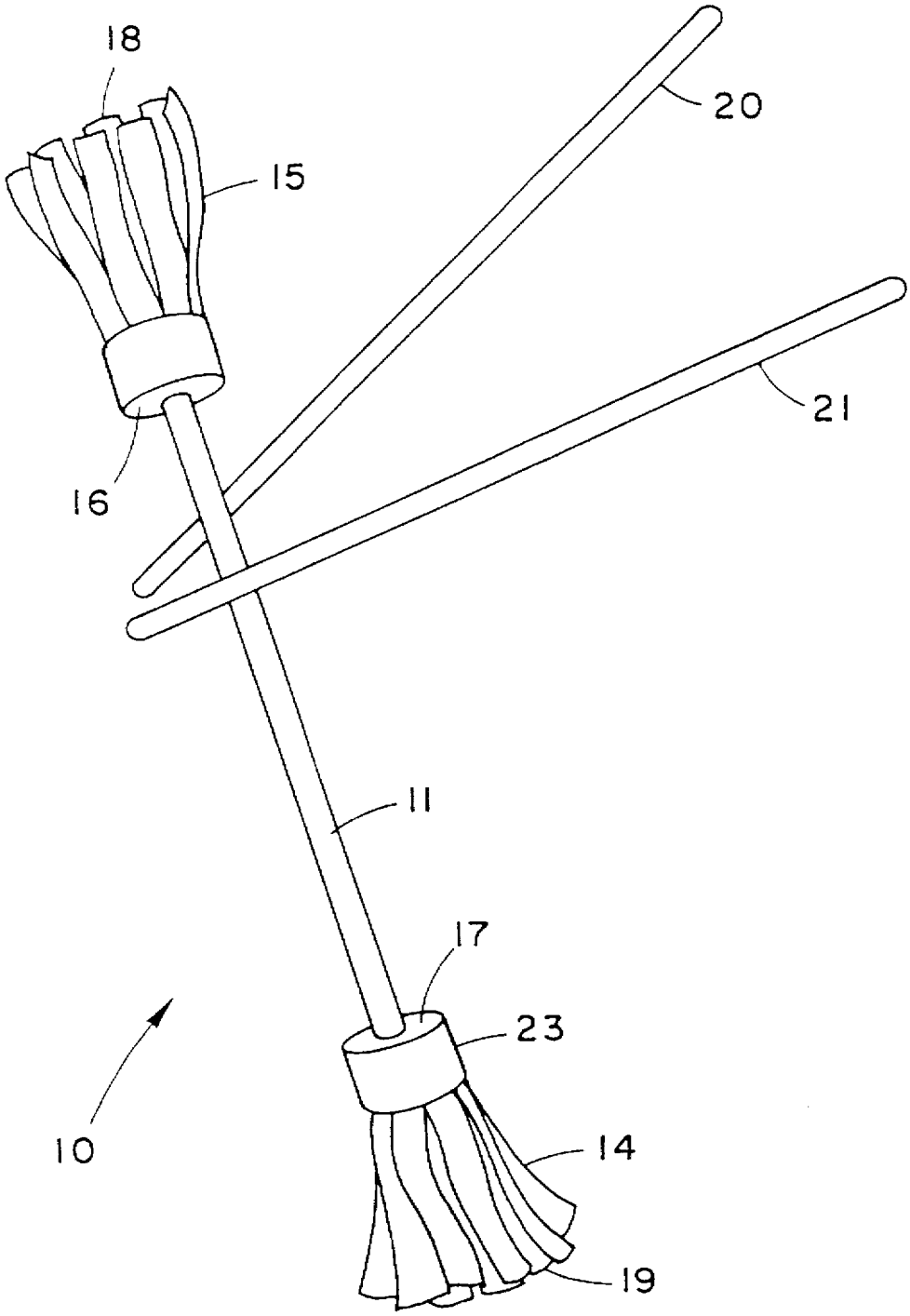
FIG. 1 is a perspective view of the game showing the interaction between the various components thereof.

FIG. 1 shows, in perspective, a game 10 comprising a main wooden stick 11 connected at opposite ends 12 and 13 thereof to respective pompons 14 and 15 (constituting endcaps) each having a respective inner-facing surface 16 and 17 and a respective outer end 18 and 19. Also provided is a pair of manipulator sticks 20 and 21 also of wood for holding by a player (not shown) so as to permit manipulation of the main stick 11 at the inner-facing surface 16 or 17 of one of the endcaps 14 or 15, respectively.

In use, the manipulator sticks 20 and 21 are held in respective hands of the player so as to grip the main stick 11 on either side thereof underneath the inner-facing surface of either of the endcaps 14 or 15. It is apparent that no special skill is required to accomplish this task because the main stick 11 is secured in space via the endcaps 14 and 15 to which the main stick 11 is firmly attached and the main stick 11 is in no way balanced by the manipulator sticks 20 and 21 at its center of gravity.

Having thus gripped the main stick 11, it may now be tossed into the air and otherwise juggled so that as it falls towards the ground, the player may use the manipulator sticks 20 and 21 to catch the main stick 11 via one of the endcaps 14 or 15. This also is relatively easy to accomplish by steadying the main stick 11 on one side thereof with the first manipulator stick 20 as it comes towards the player and immediately locating the second manipulator stick on an opposite side thereof, whereupon any natural tendency for the main stick to fall causes the inner-facing surface one of the endcaps 14 or 15 to come to rest on the two manipulator sticks 20 and 21.

Figure 2:
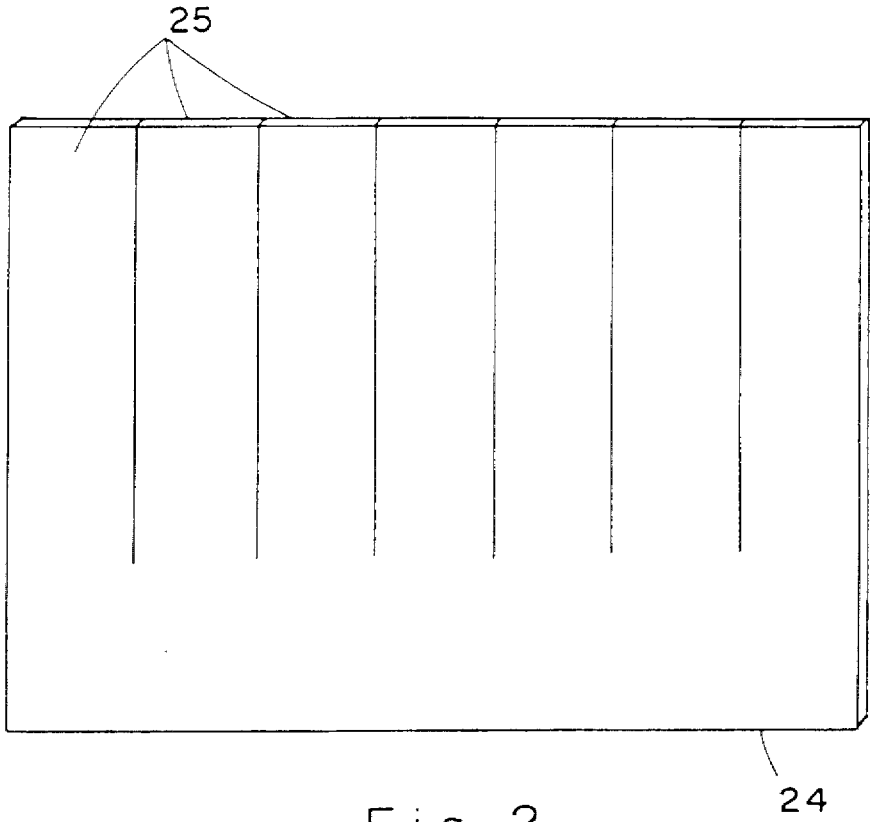
FIG. 2 shows a blank from which the endcaps are constructed.
Figure 3:
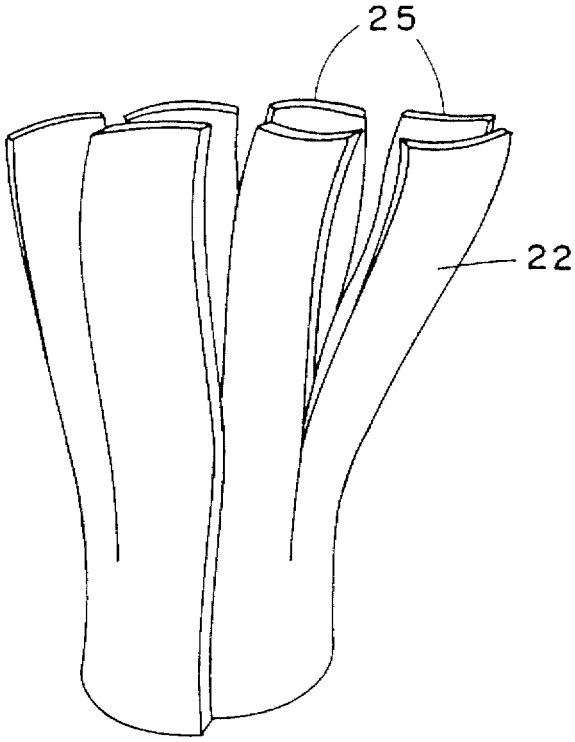
FIG. 3 is a perspective view of the one of the endcaps.

The endcaps 14 and 15 are formed of an inner core (not shown) of lightweight planar spongy material which is rolled around the opposite ends of the main stick 11 and is secured using staples or adhesive. In order to enhance its external appearance, it is then covered with an outer envelope 22 as shown in FIGS. 2 and 3. The outer envelope 22 may likewise be secured to the inner core using staples which are then covered by a strip of adhesive felt 23.

Referring to FIG. 2 there is shown a blank 24 for producing the envelope 22. The blank 24 is also formed of a lightweight planar spongy material whose length extends beyond the outer end 18 or 19 of the endcap and which is partially slit along its breadth so as to form a plurality of strips 25 so that when the envelope 22 is attached to the endcaps 14 and 15, the strips 25 extend beyond the outer end 18 and 19 of the corresponding endcap 14 and 15.

FIG. 23 shows in perspective an external view of the endcap 14 or 15 which actually reflects the outer appearance of the envelopes 22 since the inner core of each endcap 14 and 15 remains concealed by the envelope 22. Whilst the strips 25 enhance the external appearance of the endcaps 14 and 15, they also serve to make the endcaps more buoyant when the main stick 11 to which the endcaps 14 and 15 are attached is tossed into the air. Furthermore, by judicious selection of the dimensions and weights of the main stick 11, of the inner core of each of the endcaps 14 and 15 and of the envelopes 22 (as detailed below), the stick 11 and its associated components behave somewhat like a boomerang which returns to the player when thrown into the air in a substantially upright position, so as to facilitate its being captured by the manipulator sticks 20 and 21.

It has been found that the game operates particularly effectively when the dimensions and weights of the main stick 11 together with the endcaps 14 and 15 as well as the two manipulator sticks 20 and 21 are kept within ranges which have been predetermined by trial and error. These ranges as well as specific preferred values are shown in tabular form in FIG. 4.

It has further been found that the optimum length between the respective inner-facing surfaces of the endcaps 14 and 15 is 37.5 cm with a range of 27.5 to 47.5 cm, such that the main stick 11 penetrates each endcap 14 and 15 by a length of 7.25 cm. Furthermore, the optimum length of each of the strips 25 is 7.5 cm, namely half the length of the endcap envelopes 22 which have a preferred length of 15 cm. The width of each strip 25 is optimally 1.5 cm such that there are 15 strips in each endcap, bearing in mind that optimal width of the endcap envelope is 22.5 cm.

I claim:

1. A game comprising a main stick connected at opposite ends thereof to respective endcaps each having a respective inner-facing surface, and a pair of manipulator sticks for holding by a player for manipulating the main stick at the inner-facing surface of one of the endcaps on either side of the main stick; wherein:

a total combined weight of the main stick and the endcaps lies within a range of 104.5±50 g, the main stick has a length within a range of 52±20 cm, the inner-facing surface of each endcap has a diameter within a range of 1.75 to 10.75 cm, and the endcaps are separated by a distance of 40±20 cm.

2. The game according to claim 1, wherein each of the endcaps is provided with an opening through the inner-facing surface for accommodating therein a respective end of the main stick.

3. The game according to claim 2, wherein each of the endcaps comprises an inner portion surrounded by a substantially planar outer envelope which extends beyond ;an outer end of the endcap and is partially slit along a direction parallel to a longitudinal axis of the endcap so as to form a plurality of strips extending beyond the outer end of the endcap.

4. The game according to claim 3, wherein each strip extends substantially halfway through the outer envelope.

5. The game according to claim 3, wherein a total weight of the main stick and the endcaps together with both of the manipulator sticks does not exceed 180 g.

6. The game according to claim 5, wherein the main stick has a weight range between 50 and 90 gram, the inner portion of each of the endcaps has a weight range between 5 to 15 gram, the outer envelope of each of the endcaps has a weight range between 2.5 to 12.5 gram, and each of the manipulator sticks has a weight range between 10 and 60 gram.

7. The game according to claim 6, wherein the main stick has a weight of 70 gram, the inner portion of each of the endcaps has a weight of 10 gram, the outer envelope of each of the endcaps has a weight of 7.25 gram, and each of the manipulator sticks has a weight of 35 gram.

8. The game according to claim 7, wherein the main stick has a length range between 42 and 62 cm, the inner portion of each of the endcaps has a length range between 5 to 10 cm, the outer envelope of each of the endcaps has a length range between 5 to 25 cm and a width range between 12.5 and 32.5 cm, and each of the manipulator sticks has a length range between 30 and 60 cm.

9. The game according to claim 8, wherein the main stick has a length of 52 cm, the inner portion of each of the endcaps has a length of 7.25 cm, the outer envelope of each of the endcaps has a length of 15 cm and a width of 22.5 cm, and each of the manipulator sticks has a length of 47.5 cm.

10. The game according to claim 8, wherein the main stick has a perimeter range between 7 and 21 mm, the inner portion of each of the endcaps has a perimeter range between 2.5 to 10 cm, the outer envelope of each of the endcaps has slits approximately every 1.5 cm, and each of the manipulator sticks has a perimeter range between 5 and 15 cm.

11. The game according to claim 10, wherein the main stick has a perimeter 14 mm, the inner portion of each of the endcaps has a perimeter of 5.25 cm, the outer envelope of each endcap extends the perimeter of the inner portion by 0.5 cm, and each of the manipulator sticks has a perimeter of 10 cm.

12. The game according to claim 8, wherein the inner-facing surfaces of the respective endcaps are separated by a distance of 37.5±10 cm.

* * * * *